US006280280B1

(12) United States Patent
Vicino et al.

(10) Patent No.: US 6,280,280 B1
(45) Date of Patent: Aug. 28, 2001

(54) JUMPING TOY VEHICLE

(75) Inventors: Robert K. Vicino, 6064 Mohler St., San Diego, CA (US) 92120; Steven D. Stackable; Larry Love, both of La Jolla, CA (US)

(73) Assignee: Robert K. Vicino

( * ) Notice: Subject to any disclaimer, the term of this patent is extended or adjusted under 35 U.S.C. 154(b) by 0 days.

(21) Appl. No.: 09/375,226

(22) Filed: Aug. 16, 1999

(51) Int. Cl.[7] ..... A63H 27/00

(52) U.S. Cl. ..... 446/62; 446/66; 446/454; 244/16

(58) Field of Search ..... 446/34, 61, 62, 446/66, 431, 454, 456, 465, 33; 244/2, 16

(56) References Cited

U.S. PATENT DOCUMENTS 1,730,627 * 10/1929 Rogers .
1,895,750 * 1/1933 Brown .
3,610,660 * 10/1971 Price ..... 280/289
4,068,810 * 1/1978 Malewicki ..... 244/2
4,657,207 * 4/1987 Poling ..... 244/2
5,078,335 * 1/1992 David ..... 244/2
5,146,203 * 9/1992 Simuni ..... 340/443
5,580,296 12/1996 Chow ..... 446/456
5,803,790 9/1998 Tilbor et al. ..... 446/470
6,073,882 * 6/2000 Zieger ..... 244/49

* cited by examiner

*Primary Examiner*—Jacob K. Ackun, Jr.
*Assistant Examiner*—U. Cegielnik
(74) *Attorney, Agent, or Firm*—Henri J. A. Charmasson; John D. Buchaca

(57) ABSTRACT

A remotely controllable toy surface vehicle has the capability of deploying wings on command and to attain flight in the absence of any air interactive propulsion mechanism. In an alternate embodiment of the invention, the fixed wings are first pitched to keep the vehicle on the ground or water until a takeoff velocity is reached; after which the pitch of the wings is remotely adjusted for takeoff and flight.

14 Claims, 4 Drawing Sheets

JUMPING TOY VEHICLE

FIELD OF THE INVENTION

This invention relates to remotely controlled toy vehicles such as reduced-scale models of cars, boats and planes that are self-propelled and can be remotely maneuvered by wireless link.

BACKGROUND OF THE INVENTION

Remotely controlled, self-propelled toy vehicles are maneuvered by means of a very limited number of levers, knobs or joy-sticks mounted on a hand-held console. Radio or ultrasound signals are generated in response to the movements of those implements and transmitted to the vehicle. Electro-mechanical systems on the vehicle receive those signals and use them to drive servo-controls linked to the vehicle's operating mechanisms. For instance, a remotely controlled car is maneuvered by means of three types of controls — start and stop commands, left and right steering, and forward/backward commands.

Although those basic commands offer a great deal of maneuverability, the entertainment value of the toy could be greatly enhanced by additional commands that would cause the vehicle to execute more elaborate maneuvers.

It is well-known that the entertainment value of a toy or game is proportional to its flexibility and ability to challenge the imagination and skills of its operator. The operator of a remotely controllable toy car will quickly develop great skill in guiding his toy through intricate pathways and around obstacles to such a point that the use of the toy is no longer challenging or interesting.

Self-propelled toy aircraft are prone to very damaging crashes. They require a large operation area, and their fast rotating propellers create serious safety hazards. The instant invention results from an attempt to create a safe but challenging, remotely controllable, surface-and-air-plying toy.

SUMMARY OF THE INVENTION

The principal and secondary objects of this invention to enhance the entertainment value of remotely controllable toy vehicles by adding a new dimension of maneuverablity without undue increase in the complexity and cost of the toy. More specifically, it is one of the objects of this invention to allow the user of such a toy to cause a surface-operated toy vehicle such as a car or boat to leave the ground or water for a few seconds and be able to fly over small obstacles.

These and other valuable objects are achieved by providing the surface toy vehicle with a pair of foldable wings that can be remotely deployed when the vehicle has reached a given take-off velocity whereby the kinetic energy accumulated by the vehicle through its surface-interactive propulsion system lifts and propels the vehicle up to at least half its height over a short distance of at least its length in the absence of any air-reactive propulsion system such as a propeller.

In an alternate embodiment of the invention, a fixed and rigid wing is pitched to keep the vehicle on its support surface while it is gathering speed, and can be shifted to a take-off angle of attack position when sufficient velocity has been attained.

A few control elements such as positionable cannards, wingtips, tail, or flaps can be manually preset and adjusted to impart the airborne vehicle, a particular, desired behavior. For instance, wingtips can be preset to establish a turning maneuver, or compensate for cross-winds. Accordingly, the invention adds a considerable degree of capability and flexibility to such a toy, greatly enhancing its entertainment value and interest.

DESCRIPTION OF THE PREFERRED EMBODIMENTS OF THE INVENTION

Figure 1:
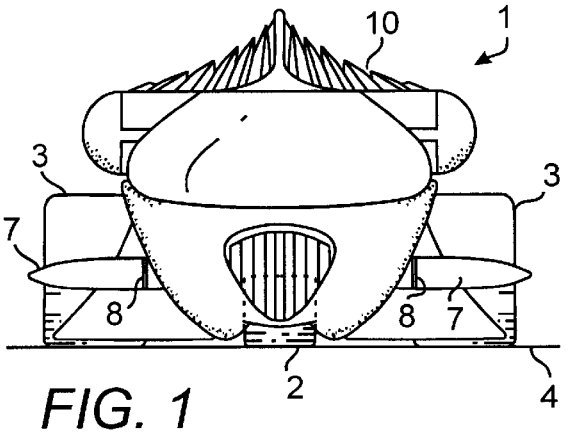
FIG. 1 is a front view of a first embodiment of a jumping toy vehicle according to the invention shown in the surface-riding mode.
Figure 2:
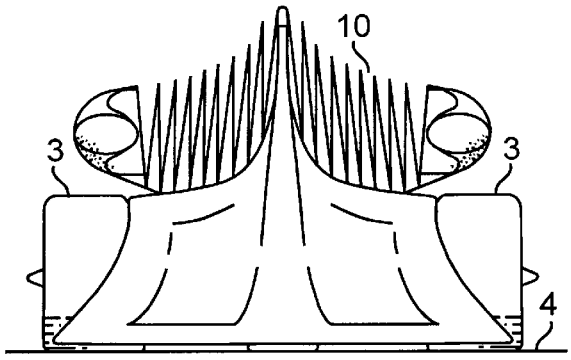
FIG. 2 is a back view thereof.
Figure 3:
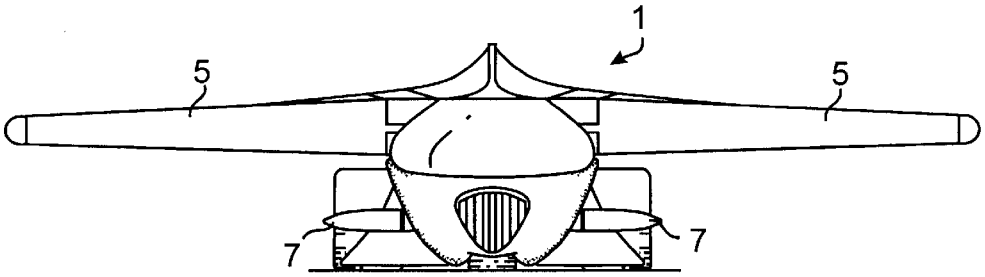
FIG. 3 is a front view of the vehicle of FIGS. 1 and 2 shown in the airborne state.
Figure 4:
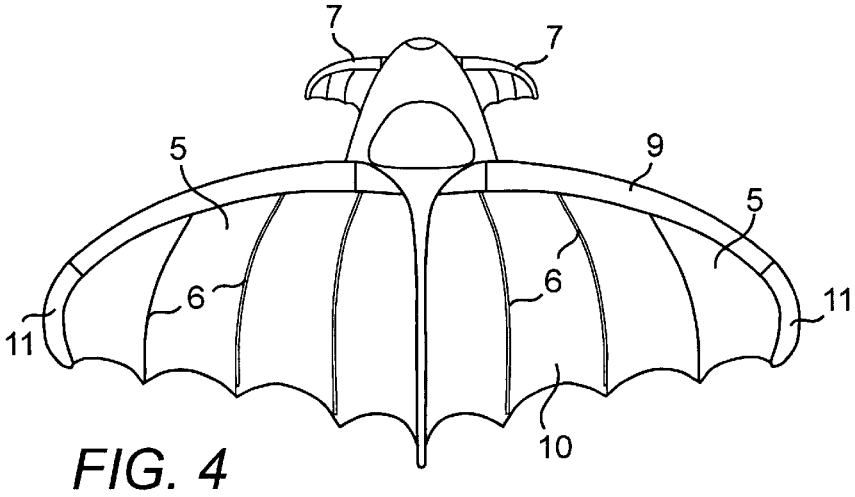
FIG. 4 is a top plan view thereof.

Referring now to the drawing, there is shown in FIGS. 1–8 a toy vehicle 1 not unlike the well-known radio-controlled toy vehicles of the prior art. Like such conventional toy vehicles, it is supported by a front 2 and rear 3 wheels for contact with a ground surface 4. At least one wheel is coupled to a motor, not shown in the drawing, that can be remotely activated to rotate that wheel in a forward or backward direction, and by reaction with the ground surface 4 propel the toy vehicle up to a certain velocity over the plane defined by the ground surface 4. The toy vehicle further comprises all the necessary servo-mechanisms and wireless communication circuits which allow an operator to remotely drive the toy vehicle in a variety of ground-hugging directions and maneuvers through the manipulation of various switches, levers, and similar control implements mounted on a hand-held console. These various mechanisms and circuits are well-known to those skilled in the art of remotely controlled toys and are not relevant to the novelty of this invention. However, the toy vehicle 1 is distinguished from the prior art by a pair of variable geometry wings 5 which are normally held in a folded position as shown in FIGS. 1 and 2 but can be remotely deployed to form a lifting airfoil as illustrated in FIGS. 3 and 4. The wings 5 are shaped and dimensioned to lift the toy vehicle after it has reached a given ground velocity, hereinafter called the "takeoff velocity" which the motor and wheel assembly must be empowered to achieve and preferably exceed. The takeoff velocity is typically ten to fifteen percent higher than the stall speed or minimum controllable air speed of the vehicle in order to accumulate enough momentum to sustain a flight of several seconds. In other words, the operator can drive the vehicle forward with the wings in their stowed position until it reaches the takeoff velocity charactrizing that particular body, then trigger the deployment of the wings and cause the toy to take off and be airborne for a few seconds in the absence of any air propulsion means such as a propeller. The altitude and duration of the flight is directly related to the amount of kinetic energy or momentum accumulated by the toy vehicle at the time of takeoff. As the accumulated kinetic energy is dissipated against the resistance of the ambient air, and the airborne speed of the vehicle falls below the level necessary to sustain the flight, the vehicle glides down toward the ground surface 4. The greater the takeoff speed in excess of the stall speed, the larger the duration of the flight. Flexible stiffening strips 6 are incorporated into each deployable wing.

In an alternate embodiment of the invention described below, the airfoil may be remotely disabled to allow operation of the toy on the ground until it again reaches or exceeds the takeoff velocity, at which time the airfoil will again be enabled for the next jump.

Figure 5:
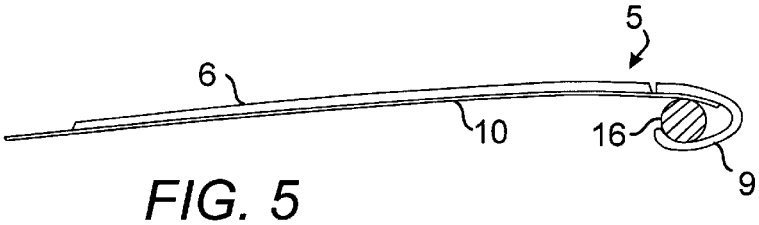
FIG. 5 is a cross-sectional view of the wing.
Figure 6:
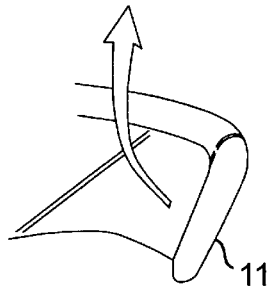
FIG. 6 is a perspective view of the adjustable wingtip.

A pair of cannards 7 are rotatively mounted on either side of the forward section of the vehicle body around pivotal points 8. Accordingly, the angle or tilt of the cannards can be manually preset prior to launching the vehicle. This adjustment could also be done remotely through a servo-mechanism. As shown in FIGS. 4 and 5, each wing comprises a leading edge boom 9 and a membrane 10 made of fabric or other pliable material secured to the boom. The distal end 11 of each boom can be manually rotated in relationship to the rest of the boom as illustrated in FIG. 6 in order to adjust the general shape of the airfoil. Accordingly, by judicial adjustment of the angle of the cannards and/or the boom tips, the flying pattern of the toy can be affected. The adjustment might be necessary to compensate for crosswind or to accommodate other environmental conditions.

Figure 7:
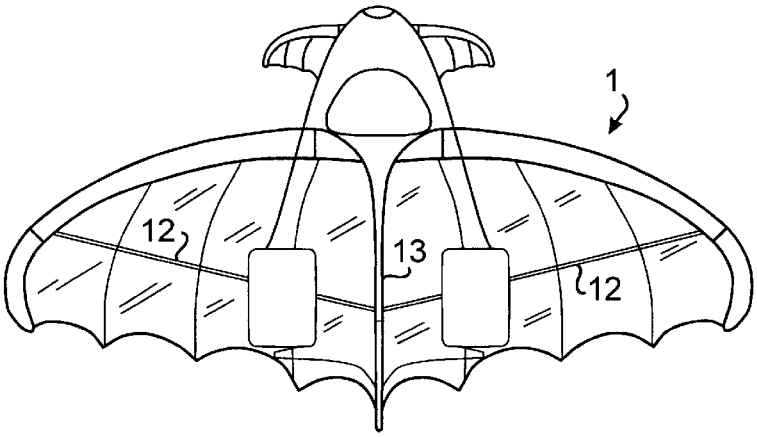
FIG. 7 is a top plan view of the deployed wings shown in transparency.

In order to achieve a quick deployment of the wings, they are preferably biased by a spring or other resilient mechanism toward full deployment, then cocked, that is forced back and held in the folded position by a trigger mechanism as will be explained below. In order to assure an orderly and snag-free bunching of the pliable membrane when the wings are folded, at least one pair of elastic cords 12 are strung under the wings between each boom 9 and the spine 13 of the vehicle as shown in FIG. 7. When the wings are folded, the retraction of the cords 12 cause the membrane to be bunched back into an accordion fold pattern 10 as illustrated in FIGS. 1 and 2.

Figure 8:
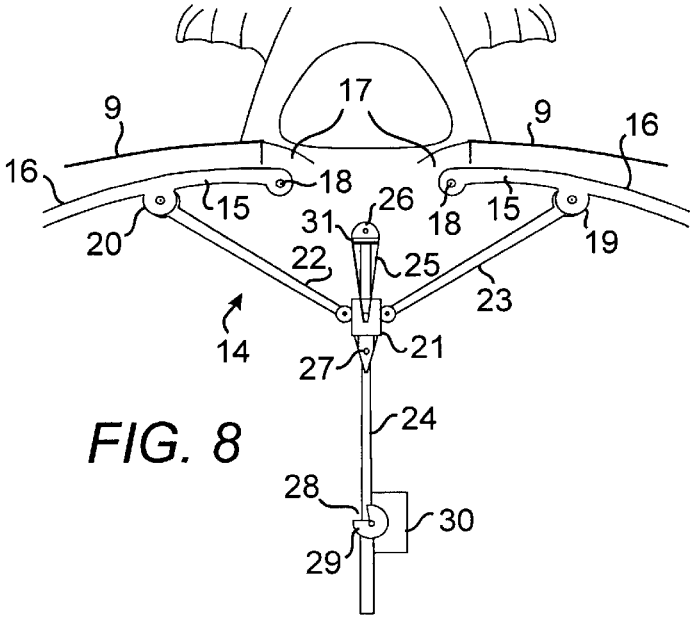
FIG. 8 is a top plan view of the wing deploying mechanism.

The wing deployment mechanism 14 illustrated in FIG. 8 is not unlike the type of parallelogram linkage used in conventional umbrellas. The root sections 15 of the boom core rods 16 forming part of the parallelogram linkage have proximal ends rotatively attached to the vehicle armature 17 at a single or at slightly spaced-apart pivotal points 18. The distal end 19, 20 are pivotally connected to a carriage 21 by a pair of rods 22, 23 at opposite ends of the section. The carriage 21 rides along a central shaft or spine 24. An elastic cord 25 strung between the forward tip 26 of the boom and the carriage 21 biases the deployment mechanism toward the deployed wing position. When the wings are folded backs a pin 27 on the carriage engages a notch 28 cut in the periphery of a rotating cam 29 driven by a servo-motor 30. Accordingly, the servo-motor 30 can be remotely triggered to rotate and move the cam 29 to a release position where the pin 27 can escape from the notch 28.

A slidably adjustable stop 31 near the forward end of the shaft 24 determines how taut the membrane will be deployed. A certain slack allowing the membrane to billow slightly may be desirable under certain conditions.

Alternately, the carriage 21 could be driven by a servo-mechanism that would allow remote deployment and refolding of the wings.

Figure 9:
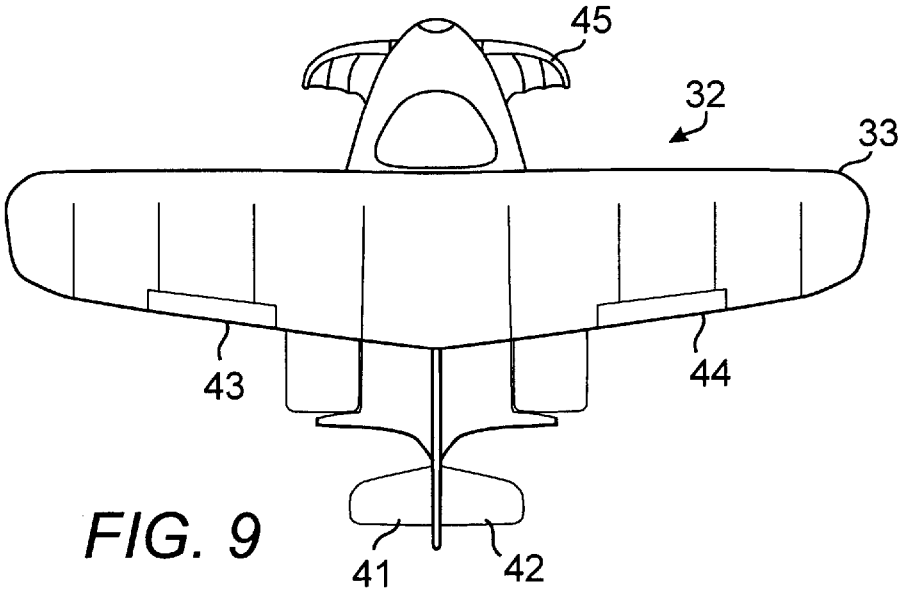
FIG. 9 is a top plan view of a second embodiment of the jumping toy vehicle.
Figure 10:
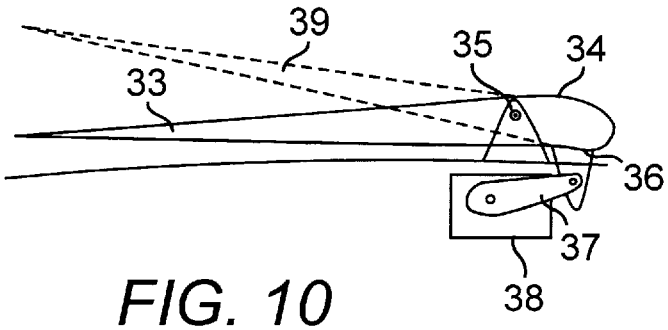
FIG. 10 is a side view of the wing angle of attack adjustment mechanism.
Figure 11:
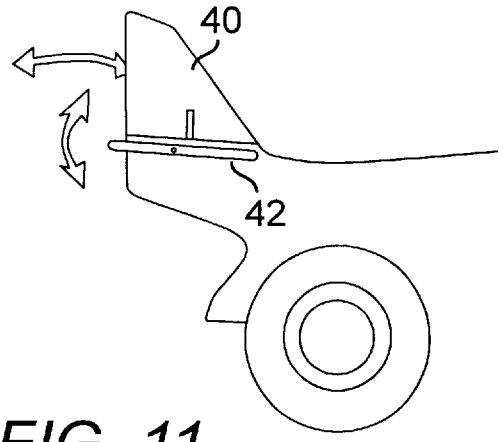
FIG. 11 is a side view of the flap and rudder configuration.

A first alternate embodiment 32 of the toy vehicle is illustrated in FIGS. 9–11. In this embodiment, the airfoil consists of a rigid wing 33 with an adjustable angle of attack. Initially and during surface travel, the wing is tilted to keep the toy vehicle in contact with the ground surface through and beyond the vehicle minimum controllable air speed. The operator has the ability to cause the wing to rotate and suddenly change its angle of attack and lift the vehicle off the ground. As more specifically illustrated in FIG. 10, the forward center part 34 of the wing is rotatively connected to a pivot point 35. The leading edge 36 of the wing is linked by a lever 37 to a servo-motor mechanism 38. When the lever 37 is rotated, the wing is tilted from the ground position 39 shown in dotted line to the takeoff position.

The wing can be remotely moved back to its initial ground-hugging position by activating a servo-motor 38 clockwise.

Manually or remotely adjustable rudder 40, flaps 41–42 and, ailerons 43,44 are provided in lieu of, or in addition to cannards 45 to impart desired flight patterns to the toy.

Figure 12:
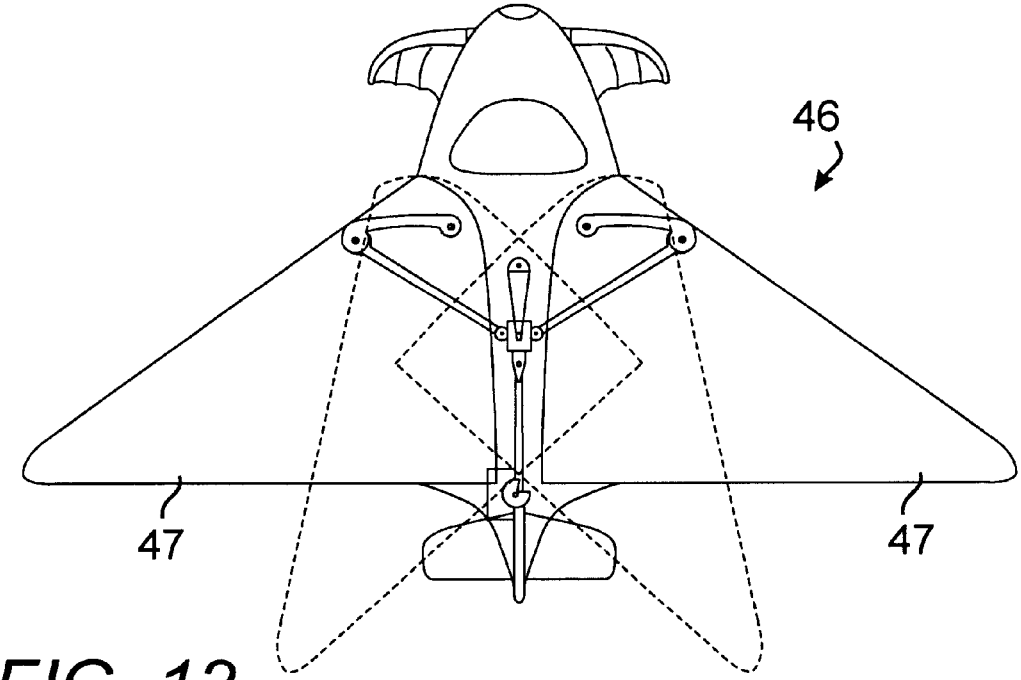
FIG. 12 is a top plan view of an alternate wing mechanism.

In the second alternate embodiment 46 of the toy vehicle illustrated in FIG. 12, the variable geometry airfoil consists of a pair of rotatable delta wings 47 which can be remotely allowed to spring from a folded position illustrated in dotted lines to the full deployed position illustrated in solid lines.

Another embodiment of rotatable airfoil may consist of a single wing pivotally secured to the vehicle about its center. The wing would be moved from a longitudinal ground travel orientation to a lifting transversal position.

Figure 13:
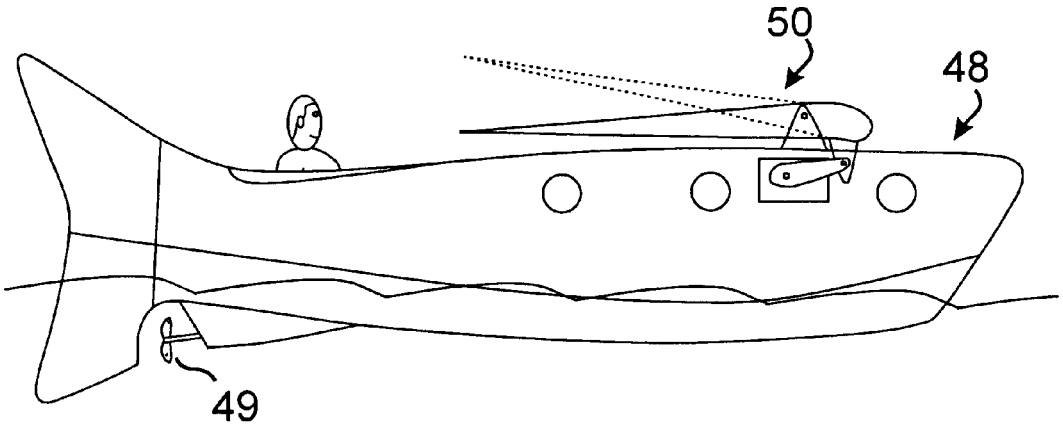
FIG. 13 is a side elevational view of a watercraft version of the invention.

In the water craft embodiment 48 of the invention illustrated in FIG. 13, the surface propulsion is provided by a propeller 49. The airfoil is constituted by a variable pitch wing structure 50 similar to the one disclosed in connection with the embodiment illustrated in FIG. 9–11.

An actual embodiment of the invention consisting of a model SP3 Extreme remotely controlled toy car, commercially available under the name ACADEMIC HOBBY MODEL KIT from ALTECH RECTIFIER CORP. of Edison, New Jersey fitted with a foldable pair of wings similar to the one disclosed in FIGS. 1–2 has been successfully operated within the following parameters. With a wing span of approximately 127 centimeters (50 inches) and a total vehicle weight of approximately 1.4 kg (3 lbs.), a takeoff velocity of approximately 25 km/hr (15.5 mph) was achieved, yielding a flight maximum altitude of approximately 1.2 meters (4 feet) over a distance of approximately 9 meters (30 feet).

It was also possible to achieve a smaller jumping maneuver by keeping the wings deployed at all times and quickly accelerating the toy beyond its stall speed up to its takeoff velocity.

It should be noted that when the vehicle is airborne, the wheels continue to gyrate either because they are still driven by the motor, or by reason of their accumulated kinetic energy. These spinning wheels acts as stabilizing gyroscopes to limit the roll of the vehicle and to yield smooth landings. The stabilizing effect of the wheel can be enhanced by increasing their number, size and weight.

The instant invention can also be embodied in a ground or water surface vehicle large enough to be ridden and driven by a human being rather than remotely controlled without substantially modifying the structures and mechanisms described above in connection with remotely controlled toy vehicles.

While the preferred embodiments of the invention have been described, modifications can be made and other embodiments may be devised without departing from the spirit of the invention and the scope of the appended claims.

What is claimed is:

1. A vehicle operable over a support surface which comprises:

propulsion means interacting with said support surface, said propulsion means being empowered to impart upon said vehicle, a given surface velocity;

means interactable with ambient air for lifting said vehicle at said given surface velocity and causing said vehicle to be temporarily airborne in the absence of any air propulsion means; and wherein said means for lifting comprises a variable geometry wing including a foldable and deployable airfoil, and means for remotely deploying said airfoil when said given surface velocity has been reached; and wherein said airfoil comprises:

two leading edge booms each rotatively connected to a central pivot point;

at least one membrane secured to said booms; and means for resiliently biasing said means for deploying toward an extended state.

2. The vehicle of claim 1, wherein said means for deploying further comprises a folding parallelogram linkage assembly including adjacent sections of said booms.

3. The vehicle of claim 1, wherein said membrane is made of soft pliable material.

4. The vehicle of claim 1, wherein said support surface comprises a ground plane; and said propulsion means comprises at least one motor-driven wheel.

5. The vehicle of claim 1 which further comprises adjustable means for imposing a flying maneuver to said vehicle when airborne.

6. The vehicle of claim 5, wherein said means for imposing a flying maneuver comprise at least one device taken from a group consisting essentially of cannards, rudder, flaps, ailerons and bendable wing tips.

7. A vehicle operable over a support surface which comprises:

an airfoil shaped, dimensioned, and positionable to lift said vehicle above said support surface when said vehicle attains a given lift-off speed; and means for keeping said airfoil in a folded, non-lifting configuration to keep said vehicle in supported contact with said surface beyond said lift-off speed;

means for unfolding said airfoil when said vehicle attains a ground velocity in excess of said lift-off speed and for causing said vehicle to be temporarily airborne in the absence of any air-interactive propulsion means;

wherein said airfoil comprises a variable geometry wing including a foldable and deployable wing; and means for remotely deploying said wing.

8. The vehicle of claim 7, wherein said wing comprises:

two symmetrical leading edge booms each rotatively connected to a central pivot point;

at least one membrane secured to said booms; and a means for resiliently biasing said means for deploying toward an extended state.

9. The vehicle of claim 7 which further comprises adjustable means for imposing a flying control to said vehicle when airborne.

10. The vehicle of claim 7, wherein said foldable and deployable wing comprises at least one rigid delta-shaped wing rotatable within a substantially horizontal plane from a folded, non-lifting position to a deployed lifting position.

11. A vehicle operable over a support surface which comprises:

a foldable airfoil shaped, dimensioned and positionable to create a lifting force sufficient to raise said vehicle above said support surface when said vehicle attains a given lift-off speed;

means for holding said airfoil in a folded and non-lifting position;

means for unfolding said airfoil into a lifting position; and means, interacting with said support surface, for imparting upon said vehicle a velocity in excess of said lift-off speed.

12. The vehicle of claim 11, wherein said means for imparting velocity and said lifting force are sufficient to temporarily keep said vehicle airborne in the absence of an air-propulsion means.

13. The vehicle of claim 12, wherein said airfoil comprises at least one rigid wing rotatable within a horizontal plane from said folded and non-lifting position to said lifting position.

14. The vehicle of claim 12 which further comprises adjustable means for imposing a flying maneuver to said vehicle when airborne.

* * * * *